US007308406B2

(12) United States Patent
Chen

(10) Patent No.: US 7,308,406 B2
(45) Date of Patent: Dec. 11, 2007

(54) METHOD AND SYSTEM FOR A WAVEFORM ATTENUATION TECHNIQUE FOR PREDICTIVE SPEECH CODING BASED ON EXTRAPOLATION OF SPEECH WAVEFORM

(75) Inventor: Juin-Hwey Chen, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 772 days.

(21) Appl. No.: 10/183,451

(22) Filed: Jun. 28, 2002

(65) Prior Publication Data

US 2003/0055631 A1 Mar. 20, 2003

Related U.S. Application Data

(60) Provisional application No. 60/312,789, filed on Aug. 17, 2001, provisional application No. 60/344,374, filed on Jan. 4, 2002.

(51) Int. Cl.
*G10L 21/00* (2006.01)
*G10L 19/04* (2006.01)

(52) U.S. Cl. ..... 704/262; 704/219; 704/228

(58) Field of Classification Search ..... 704/223, 704/219, 258, 262, 228
See application file for complete search history.

(56) References Cited

U.S. PATENT DOCUMENTS 4,920,489 A * 4/1990 Hubelbank et al. ..... 600/519
5,561,609 A * 10/1996 Kathmann et al. ..... 714/746
6,170,073 B1 * 1/2001 Jarvinen et al. ..... 714/758
6,654,716 B2 * 11/2003 Bruhn et al. ..... 704/219
6,952,668 B1 * 10/2005 Kapilow ..... 704/206
6,961,697 B1 * 11/2005 Kapilow ..... 704/228

FOREIGN PATENT DOCUMENTS

EP 1199812 A1 * 4/2002
WO WO 99/66494 12/1999
WO WO 00/63881 10/2000

OTHER PUBLICATIONS

European Search Report issued Jun. 28, 2004 for Appln. No. EP 02 25 5673, 3 pages.
Watkins, Craig R. et al., "Improving 16KB/s G.728 LD-CELP Speech Coder for Frame Erasure Channels," Acoustics, Speech, and Signal Processing, 1995. ICASSP-95., 1995 International Conference on Detroit, MI, USA May 9-12, 1995, New York, NY, USA, IEEE, US, May 9, 1995, pp. 241-244.
ITU-T Study Group 16: "Frame or Packet Loss Concealment for the LD-CELP Decoder," ITU-T Recommendation G. 728 Annex 1, May 27, 1999, pp. 1-19.

* cited by examiner

*Primary Examiner*—Tálivaldis Ivars Šmits
(74) *Attorney, Agent, or Firm*—Sterne, Kessler, Goldstein & Fox PLLC

(57) ABSTRACT

A method and system are provided for processing an extrapolated signal including a number of consecutive replacement frames. The method comprises attenuating a portion of the extrapolated signal when the extrapolated signal reaches a predetermined duration. The attenuating produces an output signal having an attenuated portion, wherein the output signal includes the number of consecutive replacement frames. Each of the consecutive frames within the attenuated portion is attenuated by applying an attenuation window with a starting magnitude value of approximately 1 and including a unique ending magnitude. The unique ending magnitudes decrease over time.

18 Claims, 6 Drawing Sheets

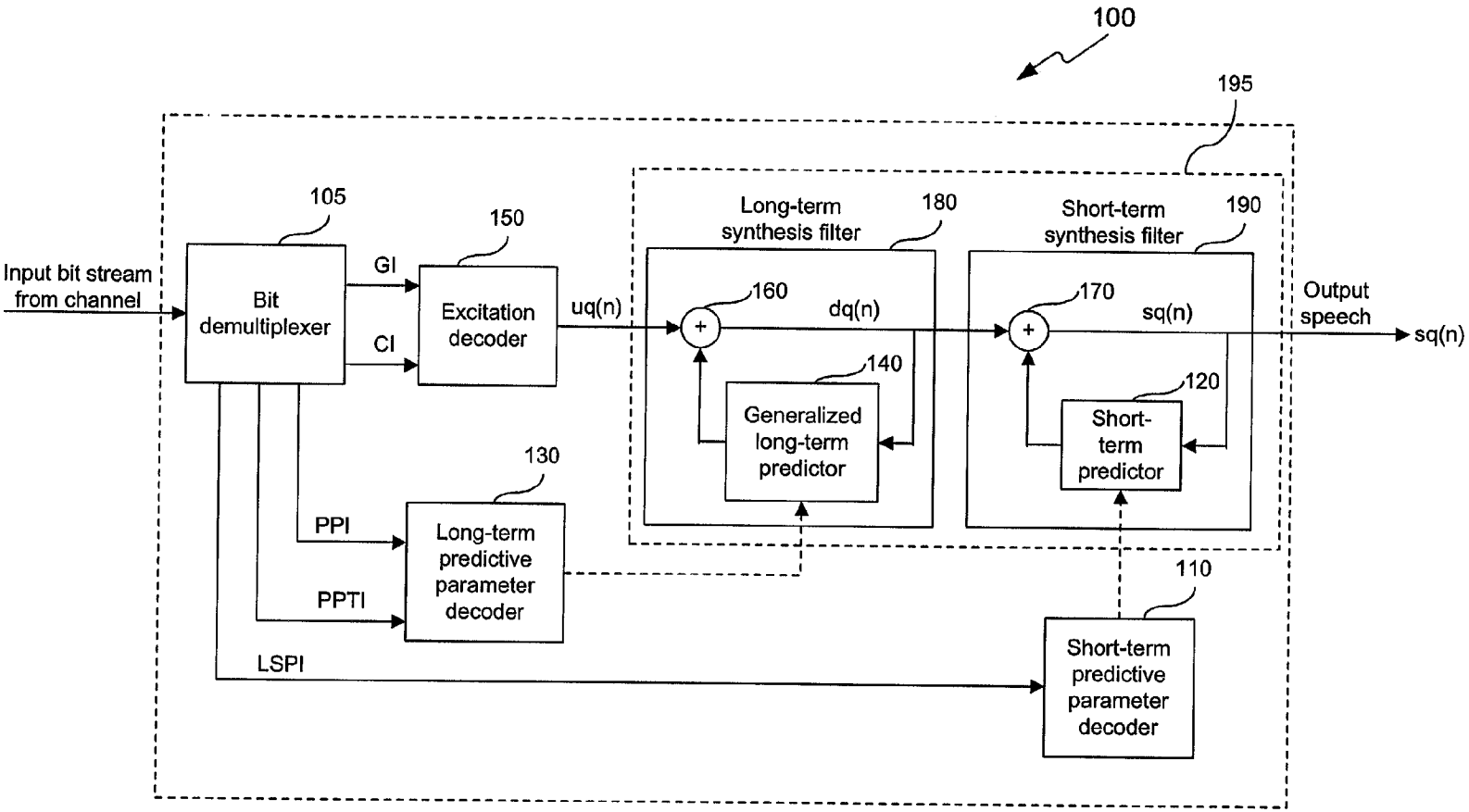
FIG. 1
(conventional)

METHOD AND SYSTEM FOR A WAVEFORM ATTENUATION TECHNIQUE FOR PREDICTIVE SPEECH CODING BASED ON EXTRAPOLATION OF SPEECH WAVEFORM

CROSS-REFERENCE TO RELATED APPLICATIONS

This application claims the benefit of U.S. Provisional Application No. 60/312,789, filed Aug. 17, 2001, entitled "Frame Erasure Concealment for Predictive Speech Coding Based On Extrapolation of Speech Waveform," and U.S. Provisional Application No. 60/344,374, filed Jan. 4, 2002, entitled "Frame Erasure Concealment for Predictive Speech Coding Based On Extrapolation of Speech Waveform," both of which are incorporated by reference herein in their entireties.

BACKGROUND OF THE INVENTION

1. Field of the Invention

The present invention relates to digital communications. More particularly, the present invention relates to the enhancement of speech quality when frames of a compressed bit stream representing a speech signal are lost within the context of a digital communications system.

2. Related Art

In speech coding, sometimes called voice compression, a coder encodes an input speech or audio signal into a digital bit stream for transmission. A decoder decodes the bit stream into an output speech signal. The combination of the coder and the decoder is called a codec. The transmitted bit stream is usually partitioned into frames. In wireless or packet networks, sometimes frames of transmitted bits are lost, erased, or corrupted. This condition is called frame erasure in wireless communications. The same condition of erased frames can happen in packet networks due to packet loss.

When frame erasure happens, the decoder cannot perform normal decoding operations since there are no bits to decode in the lost frame. During erased frames, the decoder needs to perform frame erasure concealment (FEC) operations to try to conceal the quality-degrading effects of the frame erasure.

One of the earliest FEC techniques is waveform substitution based on pattern matching, as proposed by Goodman, et al. in "Waveform Substitution Techniques for Recovering Missing Speech Segments in Packet Voice Communications", *IEEE Transaction on Acoustics, Speech and Signal Processing*, December 1986, pp. 1440-1448. This scheme was applied to Pulse Code Modulation (PCM) speech codec that performs sample-by-sample instantaneous quantization of speech waveform directly. This FEC scheme uses a piece of decoded speech waveform immediately before the lost frame as the template, and slides this template back in time to find a suitable piece of decoded speech waveform that maximizes some sort of waveform similarity measure (or minimizes a waveform difference measure).

Goodman's FEC scheme then uses the section of waveform immediately following a best-matching waveform segment as the substitute waveform for the lost frame. To eliminate discontinuities at frame boundaries, the scheme also uses a raised cosine window to perform an overlap-add technique between the correctly decoded waveform and the substitute waveform. This overlap-add technique increases the coding delay. The delay occurs because at the end of each frame, there are many speech samples that need to be overlap-added to obtain the final values, and thus cannot be played out until the next frame of speech is decoded.

Based on the work of Goodman above, David Kapilow developed a more sophisticated version of an FEC scheme for G.711 PCM codec. This FEC scheme is described in Appendix I of the ITU-T Recommendation G.711. However, both the FEC of Goodman and the FEC scheme of Kapilow are limited to PCM codecs with instantaneous quantization.

For speech coding, the most popular type of speech codec is based on predictive coding. Perhaps the first publicized FEC scheme for a predictive codec is a "bad frame masking" scheme in the original TIA IS-54 VSELP standard for North American digital cellular radio (rescinded in September 1996). Here, upon detection of a bad frame, the scheme repeats the linear prediction parameters of the last frame. This scheme derives the speech energy parameter for the current frame by either repeating or attenuating the speech energy parameter of last frame, depending on how many consecutive bad frames have been counted. For the excitation signal (or quantized prediction residual), this scheme does not perform any special operation. It merely decodes the excitation bits, even though they might contain a large number of bit errors.

The first FEC scheme for a predictive codec that performs waveform substitution in the excitation domain is probably the FEC system developed by Chen for the ITU-T Recommendation G.728 Low-Delay Code Excited Linear Predictor (CELP) codec, as described in U.S. Pat. No. 5,615,298 issued to Chen, titled "Excitation Signal Synthesis During Frame Erasure or Packet Loss." In this approach, during erased frames, the speech excitation signal is extrapolated depending on whether the last frame is a voiced or an unvoiced frame. If it is voiced, the excitation signal is extrapolated by periodic repetition. If it is unvoiced, the excitation signal is extrapolated by randomly repeating small segments of speech waveform in the previous frame, while ensuring the average speech power is roughly maintained.

What is needed therefore is an FEC technique that avoids the noted deficiencies associated with the conventional decoders. For example, what is needed is an FEC technique that avoids the increased delay created in the overlap-add operation of Goodman's approach. What is also needed is an FEC technique that can ensure the smooth reproduction of a speech or audio waveform when the next good frame is received.

SUMMARY OF THE INVENTION

Consistent with the principles of the present invention as embodied and broadly described herein, an exemplary FEC technique includes a method of synthesizing a corrupted frame output from a decoder including one or more predictive filters. The corrupted frame is representative of one segment of a decoded signal output from the decoder. The method comprises extrapolating a replacement frame based upon another segment of the decoded signal, substituting the replacement frame for the corrupted frame, and updating internal states of the filters based upon the substituting.

Further embodiments, features, and advantages of the present invention, as well as the structure and operation of the various embodiments of the present invention, are described in detail below with reference to the accompanying drawings.

BRIEF DESCRIPTION OF THE DRAWINGS

The accompanying drawings, which are incorporated in and constitute a part of the specification, illustrate an embodiment of the invention and, together with the description, explain the purpose, advantages, and principles of the invention. In the drawings:

FIG. 1 is a block diagram illustration of a conventional predictive decoder;

FIG. 3(*b*) is a plot of an exemplary normalized waveform attenuation window functioning in accordance with the present invention;

FIG. 4(*b*) is a continuation of the flowchart shown in FIG. 4(*a*)

DETAILED DESCRIPTION OF THE INVENTION

Figure 2:
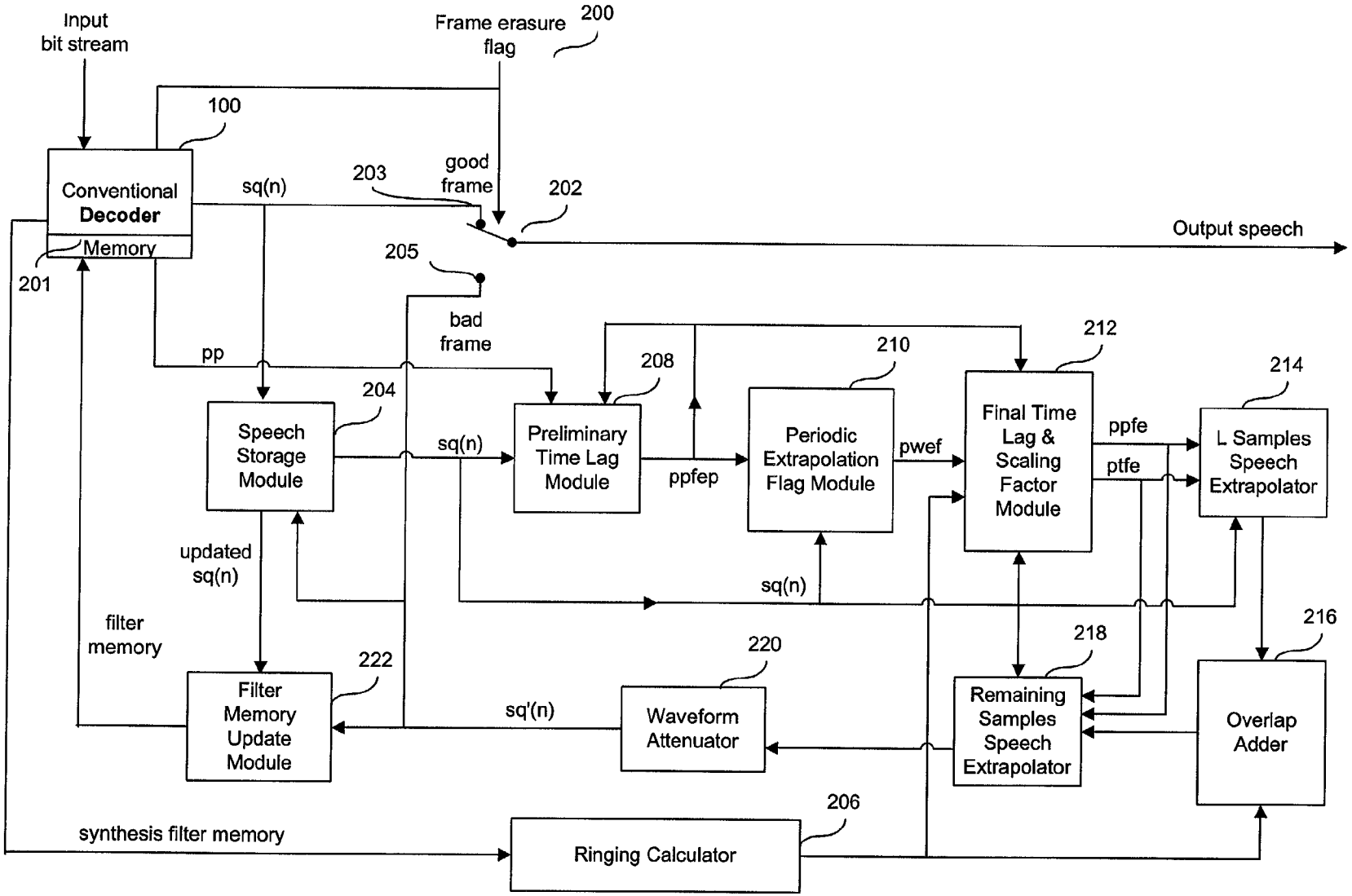
FIG. 2 is a block diagram illustration of an exemplary decoder constructed and arranged in accordance with the present invention.

The following detailed description of the present invention refers to the accompanying drawings that illustrate exemplary embodiments consistent with this invention. Other embodiments are possible, and modifications may be made to the embodiments within the spirit and scope of the present invention. Therefore, the following detailed description is not meant to limit the invention. Rather, the scope of the invention is defined by the appended claims.

It would be apparent to one of skill in the art that the present invention, as described below, may be implemented in many different embodiments of hardware, software, firmware, and/or the entities illustrated in the drawings.

Any actual software code with specialized control hardware to implement the present invention is not limiting of the present invention. Thus, the operation and behavior of the present invention will be described with the understanding that modifications and variations of the embodiments are possible, given the level of detail presented herein. Before describing the invention in detail, it is helpful to describe an exemplary environment in which the invention may be implemented.

The present invention is particularly useful in the environment of the decoder of a predictive speech codec to conceal the quality-degrading effects of frame erasure or packet loss. FIG. 1 illustrates such an environment. The general principles of the invention can be used in any linear predictive codec, although the preferred embodiment described later is particularly well suited for a specific type of predictive decoder.

The present invention is an FEC technique designed for predictive coding of speech. One characteristic that distinguishes it from the techniques mentioned above, is that it performs waveform substitution in the speech domain rather than the excitation domain. It also performs special operations to update the internal states, or memories, of predictors and filters inside the predictive decoder to ensure maximally smooth reproduction of speech waveform when the next good frame is received.

The present invention also avoids the additional delay associated with the overlap-add operation in Goodman's approach and in ITU-T G.711 Appendix I. This is achieved by performing overlap-add between extrapolated speech waveform and the ringing, or zero-input response of the synthesis filter. Other features include a special algorithm to minimize buzzing sounds during waveform extrapolation, and an efficient method to implement a linearly decreasing waveform envelope during extended frame erasure. Finally, the associated memories within the log-gain predictor are updated.

As stated above, the present invention is not restricted to a particular speech codec. Instead, it's generally applicable to predictive speech codecs, including, but not limited to, Adaptive Predictive Coding (APC), Multi-Pulse Linear Predictive Coding (MPLPC), CELP, and Noise Feedback Coding (NFC), etc.

Before discussing the principles of the invention, a description of a conventional decoder of a standard predictive codec is needed. FIG. 1 is a block diagram illustration of a conventional predictive decoder 100. The decoder 100 shown in FIG. 1 can be used to describe the decoders of APC, MPLPC, CELP, and NFC speech codecs. The more sophisticated versions of the codecs associated with predictive decoders typically use a short-term predictor to exploit the redundancy among adjacent speech samples and a long-term predictor to exploit the redundancy between distant samples due to pitch periodicity of, for example, voiced speech.

The main information transmitted by these codecs is the quantized version of the prediction residual signal after short-term and long-term prediction. This quantized residual signal is often called the excitation signal because it is used in the decoder to excite the long-term and short-term synthesis filter to produce the output decoded speech. In addition to the excitation signal, several other speech parameters are also transmitted as side information frame-by-frame or subframe-by-subframe.

An exemplary range of lengths for each frame (called frame size) can be 5 ms to 40 ms, with 10 ms and 20 ms as the two most popular frame sizes for speech codecs. Each frame usually contains a few equal-length subframes. The side information of these predictive codecs typically includes spectral envelope information in the form of the short-term predictor parameters, pitch period, pitch predictor taps (both long-term predictor parameters), and excitation gain.

In FIG. 1, the conventional decoder 100 includes a bit de-multiplexer 105. The de-multiplexer 105 separates the bits in each received frame of bits into codes for the excitation signal and codes for short-term predictor, long-term predictor, and the excitation gain.

The short-term predictor parameters, often referred to as the linear predictive coding (LPC) parameters, are usually transmitted once a frame. There are many alternative parameter sets that can be used to represent the same spectral envelope information. The most popular of these is the line-spectrum pair (LSP) parameters, sometimes called line-spectrum frequency (LSF) parameters. In FIG. 1, LSPI represents the transmitted quantizer codebook index representing the LSP parameters in each frame. A short-term predictive parameter decoder 110 decodes LSPI into an LSP parameter set and then converts the LSP parameters to the coefficients for the short-term predictor. These short-term predictor coefficients are then used to control the coefficient update of a short-term predictor 120.

Pitch period is defined as the time period at which a voiced speech waveform appears to be repeating itself periodically at a given moment. It is usually measured in terms of a number of samples, is transmitted once a subframe, and is used as the bulk delay in long-term predictors. Pitch taps are the coefficients of the long-term predictor. The bit de-multiplexer 105 also separates out the pitch period index (PPI) and the pitch predictor tap index (PPTI), from the received bit stream. A long-term predictive parameter decoder 130 decodes PPI into the pitch period, and decodes the PPTI into the pitch predictor taps. The decoded pitch period and pitch predictor taps are then used to control the parameter update of a generalized long-term predictor 140.

In its simplest form, the long-term predictor 140 is just a finite impulse response (FIR) filter, typically first order or third order, with a bulk delay equal to the pitch period. However, in some variations of CELP and MPLPC codecs, the long-term predictor 140 has been generalized to an adaptive codebook, with the only difference being that when the pitch period is smaller than the subframe, some periodic repetition operations are performed. The generalized long-term predictor 140 can represent either a straightforward FIR filter, or an adaptive codebook, thus covering most of the predictive speech codecs presently in use.

The bit de-multiplexer 105 also separates out a gain index GI and an excitation index CI from the input bit stream. An excitation decoder 150 decodes the CI into an unscaled excitation signal, and also decodes the GI into the excitation gain. Then, it uses the excitation gain to scale the unscaled excitation signal to derive a scaled excitation gain signal uq(n), which can be considered a quantized version of the long-term prediction residual. An adder 160 combines the output of the generalized long-term predictor 140 with the scaled excitation gain signal uq(n) to obtain a quantized version of a short-term prediction residual signal dq(n). An adder 170 combines the output of the short-term predictor 120 to dq(n) to obtain an output decoded speech signal sq(n).

A feedback loop is formed by the generalized long-term predictor 140 and the adder 160 and can be regarded as a single filter, called a long-term synthesis filter 180. Similarly, another feedback loop is formed by the short term predictor 120 and the adder 170. This other feedback loop can be considered a single filter called a short-term synthesis filter 190. The long-term synthesis filter 180 and the short-term synthesis filter 190 combine to form a synthesis filter module 195.

In summary, the conventional predictive decoder 100 depicted in FIG. 1 decodes the parameters of the short-term predictor 120 and the long-term predictor 140, the excitation gain, and the unscaled excitation signal. It then scales the unscaled excitation signal with the excitation gain, and passes the resulting scaled excitation signal uq(n) through the long-term synthesis filter 180 and the short-term synthesis filter 190 to derive the output decoded speech signal sq(n).

When a frame of input bits is erased due to fading in a wireless transmission or due to packet loss in packet networks, the decoder 100 in FIG. 1 unfortunately looses the indices LSPI, PPI, PPTI, GI, and CI, needed to decode the speech waveform in the current frame.

According to the principles of the present invention, the decoded speech waveform immediately before the current frame is stored and analyzed. A waveform-matching search, similar to the approach of Goodman is performed, and the time lag and scaling factor for repeating the previously decoded speech waveform in the current frame are identified.

Next, to avoid the occasional buzz sounds due to repeating a waveform at a small time lag when the speech is not highly periodic, the time lag and scaling factor are sometimes modified as follows. If the analysis indicates that the stored previous waveform is not likely to be a segment of highly periodic voiced speech, and if the time lag for waveform repetition is smaller than a predetermined threshold, another search is performed for a suitable time lag greater than the predetermined threshold. The scaling factor is also updated accordingly.

Once the time lag and scaling factor have been determined, the present invention copies the speech waveform one time lag earlier to fill the current frame, thus creating an extrapolated waveform. The extrapolated waveform is then scaled with the scaling factor. The present invention also calculates a number of samples of the ringing, or zero-input response, output from the synthesis filter module 195 from the beginning of the current frame. Due to the smoothing effect of the short-term synthesis filter 190, such a ringing signal will seem to flow smoothly from the decoded speech waveform at the end of the last frame. The present invention then overlap-adds this ringing signal and the extrapolated speech waveform with a suitable overlap-add window in order to smoothly merge these two pieces of waveform. This technique will smooth out waveform discontinuity at the beginning of the current frame. At the same time, it avoids the additional delays created by G.711 Appendix I or the approach of Goodman.

If the frame erasure has persisted for an extended period of time, the extrapolated speech signal is attenuated toward zero. Otherwise, it will create a tonal or buzzing sound. In the present invention, the waveform envelope is attenuated linearly toward zero if the length of the frame erasure exceeds a certain threshold. The present invention then uses a memory-efficient method to implement this linear attenuation toward zero.

After the waveform extrapolation is performed in the erased frame, the present invention properly updates all the internal memory states of the filters within the speech decoder. If updating is not performed, there would be a large discontinuity and an audible glitch at the beginning of the next good frame. In updating the filter memory after a frame erasure, the present invention works backward from the output speech waveform. The invention sets the filter memory contents to be what they would have been at the end of the current frame, if the filtering operations of the speech decoder were done normally. That is, the filtering operations are performed with a special excitation such that the resulting synthesized output speech waveform is exactly the same as the extrapolated waveform calculated above.

As an example, if the short-term predictor 120 is of an order M, then the memory of the short-term synthesis filter 190, after the FEC operation for the current frame, is simply the last M samples of the extrapolated speech signal for the current frame with the order reversed. This is because the short-term synthesis filter 190 in the conventional decoder 100 is an all-pole filter.

The filter memory is simply the previous filter output signal samples in reverse order.

An example of updating the memory of the FIR long-term predictor 140 will be presented. In this example, the present invention performs short-term prediction error filtering of the extrapolated speech signal of the current frame, with initial memory of the short-term predictor 120 set to the last M samples (in reverse order) of the output speech signal in the last frame.

Similarly, if quantizers for side information (such as LSP and excitation gain) use inter-frame predictive coding, then the memories of those predictors are also updated based on the same principle to minimize the discontinuity of decoded speech parameters at the next good frame.

The general principles of the present invention outlined above are applicable to almost any predictive speech decoder. What will be described in greater detail below is a particular implementation of those general principles, in a preferred embodiment of the present invention applied to the decoder of a two-stage noise feedback codec.

FIG. 2 is a block diagram illustration of an exemplary embodiment of the present invention. In FIG. 2, a conventional predictive speech decoder is shown. The decoder can be, for example, the decoder 100 shown in FIG. 1., which includes a filter memory 201 and an input frame erasure flag 200. If the input frame erasure flag 200 indicates that the current frame received is a good frame, the decoder 100 performs normal decoding operations as described above. During the normal decoding operations, a switch 202 is in an upper position 203 indicating a received good frame, and the decoded speech waveform sq(n) is used as the output of the decoder 100. Furthermore, the current frame of decoded speech sq(n) is also passed to a speech storage module 204, which stores the previously decoded speech waveform samples in a buffer. The current frame of decoded speech sq(n) is used to update that buffer. The remaining modules in FIG. 2 are inactive when a good frame is received.

On the other hand, if the input frame erasure flag 200 indicates that a bad frame has been received or that the current frame is not received (e.g., erased or lost), the operation of the decoder 100 is halted, and the switch 202 is set to a lower position 205. The remaining modules of FIG. 2 then perform FEC operations to produce an output speech waveform sq'(n) for the current frame, and also update the filter memory 201 of the decoder 100 to prepare the decoder 100 for the normal decoding operations of the next received good frame. When the switch 202 is set to the lower position 205, the remaining modules shown in FIG. 2 operate in the following manner.

A ringing calculator 206 calculates L samples of ringing, or zero-input response, of the synthesis filter module 195 of FIG. 1. A simpler approach is to use only the short-term synthesis filter 190, but the preferred approach, at least for voiced speech, is to use the ringing of the cascaded long-term synthesis filter 180 and the short-term synthesis filter 190. This calculation is performed in the following manner. Beginning with the memory 201 of the synthesis filter module 195 left in the delay line after the processing of the last frame, filtering operations are performed for L samples while using a zero input signal to the filter 195. The resulting L samples of the filter output signal form the desired ringing signal. These L samples of the ringing signal, {r(n), n=1, 2, . . . , L}, are stored for later use.

A preliminary time lag module 208 analyzes the previously decoded speech waveform samples stored in the speech storage module 204 to determine a preliminary time lag for waveform extrapolation in the current frame. This can be done in a number of ways, for example, using the approaches outlined by Goodman. The present invention searches for a pitch period pp in the general sense, as in a pitch-prediction-based speech codec. If the conventional decoder 100 has a decoded pitch period of the last frame, and if it is deemed reliable, then the time lag module 208 can simply search around the neighborhood of this pitch period pp to find a suitable time lag. If the decoder 100 does not provide a decoded pitch period, or if this pitch period is deemed unreliable, then the preliminary time lag module 208 can perform a full-scale pitch estimation to get a desired time lag. In FIG. 2, it is assumed that such a decoded pp is indeed available and reliable. In this case, the preliminary time lag module 208 operates as follows.

First, the preliminary time lag module 208 determines the pitch period of the last frame (pplast). It sets pplast=pp=the decoded pitch period of last frame, if the last frame is a good frame. It sets pplast=the preliminary pitch period (ppfep) of the last frame (output from the time lag module 208) if the last frame is a bad frame. If, for example, pplast is smaller than 10 ms (80 samples and 160 samples for 8 kHz and 16 kHz sampling rates, respectively), the time lag module 208 uses it as an analysis window size K. If pplast is greater than 10 ms, the time lag module 208 uses 10 ms as the analysis window size K.

The preliminary time lag module 208 then determines the pitch search range. To do this, it subtracts 0.5 ms (4 samples and 8 samples for 8 kHz and 16 kHz sampling, respectively) from pplast, compares the result with the minimum allowed pitch period in the codec, and chooses the larger of the two as a lower bound lb of the search range. It then adds 0.5 ms to pplast, compares the result with the maximum allowed pitch period in the codec, and chooses the smaller of the two as the upper bound ub of the search range.

An sq(n) buffer within the speech storage module 204 stores $N+N_f$ samples of speech, where the samples sq(n), n=1, 2, . . . , N correspond to the decoder output speech for previous frames, with sq(N) being the last sample of decoded speech in the last frame. $N_f$ is the number of samples in a frame. The storage space sq(n), n=N+1, N+2, . . . , $N+N_f$ are unpopulated at the beginning of a bad frame, but will be filled with extrapolated speech waveform samples once the operations of modules 208 through 220 are completed.

For time lags j=lb, lb+1, lb+2, . . . , ub−1, ub, the preliminary time lag module 208 calculates the correlation value $$c(j) = \sum_{n=N-K+1}^{N} sq(n)sq(n-j)$$

for j∈[lb,ub]. Among those time lags that give a positive correlation c(j), the time lag module 208 finds the time lagj that maximizes $$nc(j) = \frac{\left(\sum_{n=N-K+1}^{N} sq(n)sq(n-j)\right)^2}{\sum_{n=N-K+1}^{N} sq^2(n-j)}.$$

The division operation above can be avoided by a cross-multiply method. The time lagj that maximizes nc(j) is also the lag time within the search range that maximizes the pitch prediction gain for a single-tap pitch predictor. The optimal time lag ppfep, denotes pitch period for frame erasure, preliminary version. In the extremely rare case where no c(j) in the search range is positive, ppfep is set to equal lb in this degenerate case.

If this time lag is used directly as the time lag for periodic repetition in waveform extrapolation of the current frame, buzzing sounds can occur when a small time lag is used in a segment of speech that does not have a high degree of periodicity. To combat this problem, the present invention employs a periodic extrapolation flag module 210 to distinguish between highly periodic voiced speech segments and other types of speech segments. If the extrapolation flag module 210 determines that the decoded speech is, for example, within a highly periodic voiced speech region, it sets the periodic waveform extrapolation flag (pwef) to 1; otherwise, pwef is set to 0. If pwef is 0, then a final time lag and scaling factor module 212 will determine another larger time lag to reduce or eliminate the buzzing sound.

Using ppfep as its input, the extrapolation flag module 210 performs a further analysis of the previously decoded speech sq(n) to determine the proper setting of the periodic waveform extrapolation flag pwef Again, this can be done in a number of different ways. Described below is merely one example. The extrapolation flag module 210 first sets the pwef to its default value of 1, then it calculates the speech energy E in the analysis window:

$$E = \sum_{n=N-K+1}^{N} sq^2(n)$$

If E is smaller than a certain threshold $E_0$, then the pwef is set to 0. An appropriate value of $E_0$ may be $2^{11}K$ if the input signal samples are represented as 16-bit signed integers. If $E>E_0$, then the module 210 further calculates the first normalized autocorrelation coefficient $$\rho_1 = \frac{\sum_{n=N-K+2}^{N} sq(n)sq(n-1)}{E}$$

If $\rho_1$ is less than a threshold of, say, $T_1=0.4$, the pwef is set to 0; otherwise, the module 210 checks whether the following inequality is true:

$$E < \left[F_1 + \frac{F_2 - F_1}{T_2 - T_1}(\rho_1 - T_1)\right][E - nc(ppfep)]$$

Exemplary values of the parameters are $T_1=0.4$, $T_2=0.99$, $F_1=2.0$, and $F_2=1.1$. If this inequality is true, then the pwef is set to 0. If pwef survives all three tests above, its value remains at the default value of 1.

The inequality above can be understood as follows. Assume that $E-nc(ppfep)\neq 0$, which is generally true unless the signal energy E itself is zero. Dividing both sides of the inequality by E−nc(ppfep) yields:

$$\frac{E}{E - nc(ppfep)} < \left[F_1 + \frac{F_2 - F_1}{T_2 - T_1}(\rho_1 - T_1)\right]$$

The ratio on the left-hand side is the "single-tap pitch prediction gain" in the linear domain (rather than log domain) for the decoded speech in the analysis window $n \in [(N-K+1), N]$, when the pitch period is ppfep. The expression on the right-hand side is a linear function of $\rho_1$, or $\gamma=f(\chi)=f(\rho_1)$, representing a straight line passing through the two points $(T_1,F_1)$ and $(T_2,F_2)$ in the X-Y plane. With the exemplary parameter values given above, if $\rho_1=0.4$, the threshold for the pitch prediction gain is 2.0 in the linear domain. If the pitch prediction gain is less than this threshold of 2.0, the decoded speech in the analysis window is not considered to be highly periodic voiced speech, and pwef is set to 0. This threshold is reduced to 1.1 if $\rho_1=0.99$. If $\rho_1$ is between 0.4 and 0.99, then the threshold is determined by the straight line connecting (0.4, 2.0) and (0.99, 1.1). The idea is that when the first normalized autocorrelation coefficient $\rho_1$ is smaller, the pitch prediction gain threshold is required to be larger, and vice versa. This threshold is adaptive according to the value of $\rho_1$.

Based on the preliminary time lag ppfep and the periodic waveform extrapolation flag pwef, the final time lag and scaling factor module 212 determines the final time lag and scaling factor for waveform extrapolation in the current frame.

If pwef=1, or if ppfep is no smaller than a threshold $T_0$ then ppfep is used as the final time lag, i.e., ppfe=ppfep, and the scaling factor ptfe (for pitch tap for frame erasure) is calculated as $$ptfe = \frac{\sum_{n=N-K+1}^{N} |sq(n)|}{\sum_{n=N-K+1}^{N} |sq(n - ppfe)|}.$$

The denominator in the equation above is typically non-zero. In the degenerate case when it is zero, then ptfe is also set to zero. If ptfe>1.1, then ptfe is set to 1.1 to avoid ramping up extrapolated waveform too fast. A suitable value of $T_0$ is the number of samples corresponding to a 10 ms time interval.

The scaling factor ptfe calculated above is normally positive. However, in the rare case when c(ppfe), the correlation value at time lag ppfe, is negative, as discussed above with regard to the preliminary time lag module 208, then the scaling factor ptfe calculated above should be negated. If the negated value is less than −1, it is clipped at −1.

If pwef=0 and $ppfep<T_0$, there is a higher likelihood for periodic waveform extrapolation to produce a buzz sound. To avoid the potential buzzing sound, the present invention searches for another suitable time lag $ppfe \geqq T_0$. By requiring the time lag ppfe to be large enough, the likelihood of a buzzing sound is greatly reduced. To minimize the potential quality degradation caused by a misclassification of a periodic voiced speech segment into something that is not, the present invention searches in the neighborhood of the first integer multiple of ppfep that is no smaller than $T_0$. That way, even if the pwef should have been 1 and is misclassified as 0, there is a good chance that an integer multiple of the true pitch period will be chosen as the final time lag for periodic waveform extrapolation.

The module 212 determines the final time lag ppfe and scaling factor ptfe in the following way if pwef=0 and $ppfep<T_0$. First, it finds the smallest integer m that satisfies the expression $$m \times ppfep \geqq T_0.$$

Then, it sets $m_1$, the lower bound of the time lag search range, to m×ppfep−3 or $T_0$, whichever is larger. The upper bound of the search range is set to $m_2=m_1+N_s-1$, where $N_s$ is the number of possible time lags in the search range. Next, for each time lagj in the search range of $[m_1,m_2]$, the module 212 calculates $$D(j) = \sum_{n=1}^{d} (sq(N + n - j) - r(n))^2,$$

and then selects the time lagj $\in [m_1,m_2]$ that minimizes D(j). Basically, the search looks for a piece of previously decoded speech waveform that is closest to the first d samples of the ringing of the synthesis filter. Normally d<L, and a possible value for d is 2. The time lagj that minimizes D(j) above is chosen as the final time lag ppfe. The corresponding scaling factor is calculated as $$ptfe = \frac{\sum_{n=1}^{d} |r(n)|}{\sum_{n=1}^{d} |sq(N+n-ppfe)|}.$$

Again, in the degenerate case when the denominator of the equation above is zero, ptfe is also set to zero. In addition, if the ptfe calculated this way is greater than 1.3, then it is clipped to 1.3.

After ppfe and ptfe are both determined, an L samples speech extrapolation module 214 extrapolates the first L samples of speech in the current frame. A possible value of L is 5 samples. The extrapolation of the first L samples of the current frame can then be expressed as $$sq(n)=ptfe\times sq(n-ppfe), \text{ for } n=N+1, N+2, \ldots, N+L.$$

For the first L samples of the current frame, an overlap-adder 216 smoothly merges the sq(n) signal extrapolated above with r(n), the ringing of the synthesis filter calculated in the ringing calculator 206, using the overlap-add method below.

$$sq(N+n)\leftarrow w_u(n)sq(N+n)+w_d(n)r(n), \text{ for } n=1, 2, \ldots, L.$$

In the equation above, the sign "←" means the quantity on its right-hand side overwrites the variable values on its left-hand side. The window function $w_u(n)$ represents the overlap-add window that is ramping up, while $w_d(n)$ represents the overlap-add window that is ramping down. These overlap-add windows satisfies the constraint:

$$w_u(n)+w_d(n)=1$$

A number of different overlap-add windows can be used. For example, the raised cosine window mentioned in the paper by Goodman can be used here. Alternatively, simpler triangular windows can also be used.

After the first L samples of the current frame are extrapolated and overlap-added, a remaining samples speech extrapolator 218 then extrapolates the remaining samples of the current frame. If ppfe≧$N_f$, the extrapolation is performed as $$sq(n)=ptfe\times sq(n-ppfe), \text{ for } n=N+L+1, N+L+2, \ldots, N+N_f.$$

If ppfe<$N_f$, then the extrapolation is performed as sq(n)=ptfe×sq(n−ppfe), for n=N+L+1, N+L+2, . . . , N+ppfe, and then sq(n)=sq(n−ppfe), for n=N+ppfe+1, N+ppfe+2, . . . , N+$N_f$.

The elimination of the scaling factor ptfe from the second cycle on is to avoid too much waveform magnitude growth due to extrapolation of high-pitched speech (low pitch period) during extended frame erasure.

If the frame erasure lasts for an extended time period, the FEC scheme should not continue the periodic extrapolation indefinitely, otherwise the extrapolated speech begins to resemble the sound of a steady tone signal. In the preferred embodiment of the present invention, a waveform attenuator 220 starts waveform attenuation at the instant when the frame erasure has lasted for 20 ms. From there, the envelope of the extrapolated waveform is attenuated linearly toward zero and the waveform magnitude reaches zero at 60 ms into the erasure of consecutive frames. After 60 ms, the output is completely muted. An exemplary attenuation technique performed in accordance with the present invention is shown in FIG. 3(*a*).

The preferred embodiment of the present invention can be used with a noise feedback codec that has, for example, a frame size of 5 ms. In this case, the time interval between each adjacent pair of vertical lines in FIG. 3(*a*) represent a frame.

Figure 3A:
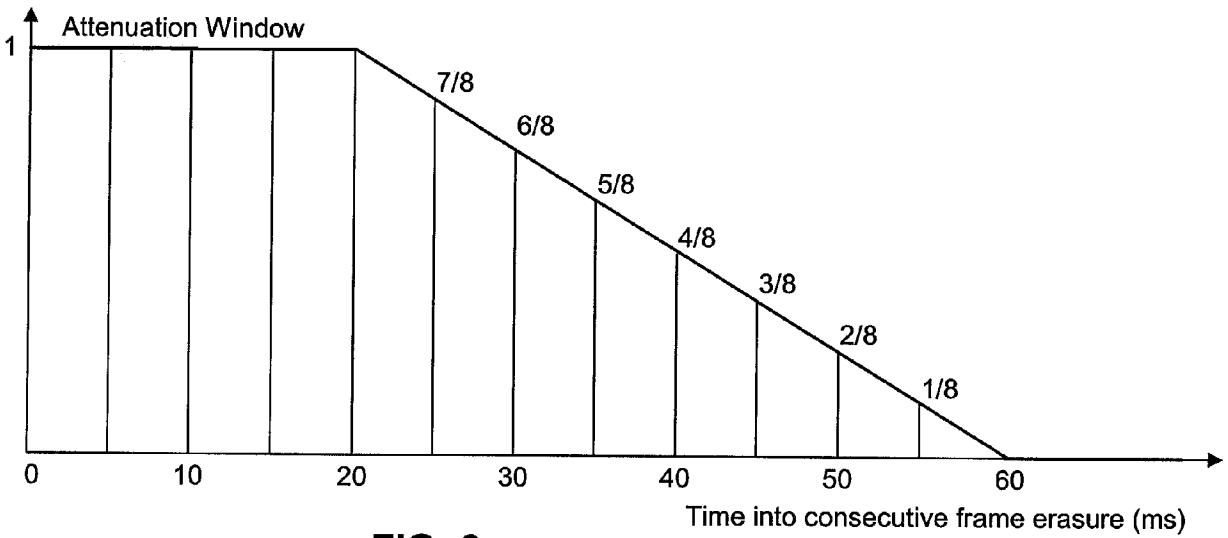
FIG. 3(*a*) is a plot of an exemplary unnormalized waveform attenuation window functioning in accordance with the present invention.
Figure 3B:
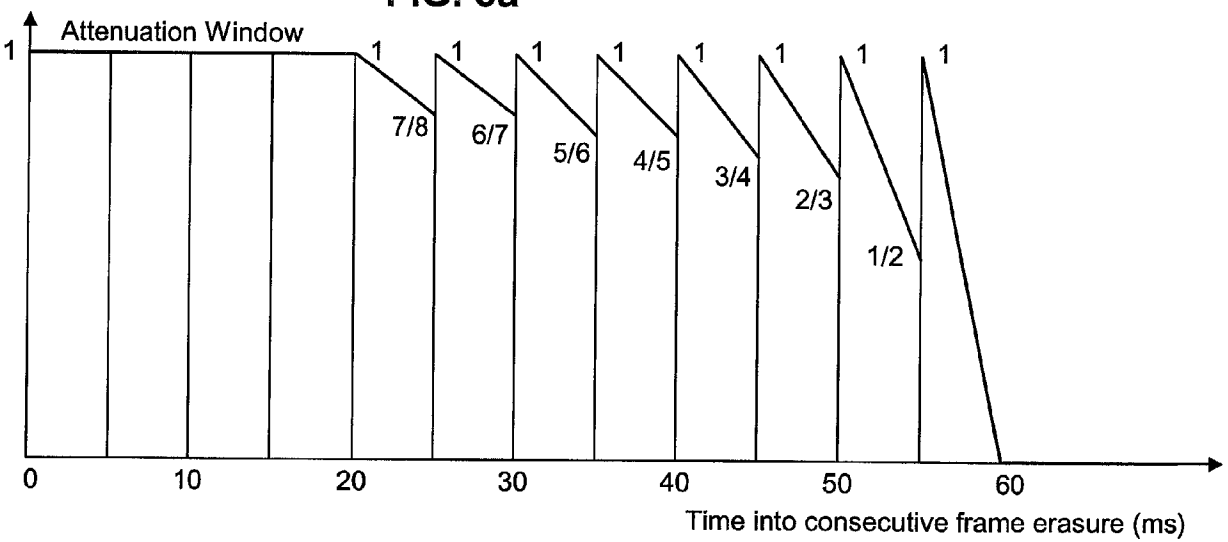

If a frame erasure lasts, for example, for 12 consecutive frames (5×12=60 ms) or more, the easiest way to implement this waveform attenuation is to extrapolate speech for the first 12 erased frames, store the resulting 60 ms of waveform, and then apply the attenuation window in FIG. 3(*a*). However, this simple approach requires extra delay to buffer up 60 ms of extrapolated speech.

To avoid any additional delay, the waveform attenuator 220 in FIG. 2 applies the waveform attenuation window frame-by-frame without any additional buffering. However, starting from the sixth consecutive erased frame, from 25 ms on in FIG. 3(*a*), the attenuator 220 cannot directly apply the corresponding section of the window for that frame in FIG. 3(*a*). A waveform discontinuity will occur at the frame boundary, because the corresponding section of the attenuation window starts from a value less than unity (7/8, 6/8, 5/8, etc.). This will cause a sudden decrease of waveform sample value at the beginning of the frame, and thus an audible waveform discontinuity.

To eliminate this problem, the present invention normalizes each 5 ms section of the attenuation window in FIG. 3(*a*) by its starting value at the left edge. For example, for the sixth frame (25 ms to 30 ms), the window is from 7/8 to 6/8, and normalizing this section by 7/8 will give a window from 1 to (6/8)/(7/8)=6/7. Similarly, for the seventh frame (30 ms to 35 ms), the window is from 6/8 to 5/8, and normalizing this section by 6/8 will give a window from 1 to (5/8)/(6/8)=5/6. Such a normalized attenuation window for each frame is shown in FIG. 3(*b*).

As illustrated in FIG. 3(*b*), rather than storing every sample in the normalized attenuation window, the present invention can simply store the decrement between adjacent samples of the window for each of the eight window sections from fifth to twelfth frame. This decrement is the amount of total decline of the window function in each frame (1/8 for the fifth erased frame, 1/7 for the sixth erased frame, and so on), divided by $N_f$, the number of speech samples in a frame.

In the example above, if the frame erasure has lasted for only 20 ms or less, the waveform attenuator 220 does not need to perform any waveform attenuation operation. If the frame erasure has lasted for more than 20 ms, then the attenuator 220 applies the appropriate section of the normalized waveform attenuation window in FIG. 3(*b*), depending on how many consecutive frames have been erased so far. For example, if the current frame is the sixth consecutive frame that is erased, then the attenuator 220 applies the section of the window from 25 ms to 30 ms (with window function from 1 to 6/7). Since the normalized waveform attenuation window for each frame always starts with unity, the windowing operation will not cause any waveform discontinuity at the beginning of the frame.

The normalized window function is not stored. Instead, it is calculated on the fly. Starting with a value of 1, the attenuator 220 multiplies the first waveform sample of the current frame by 1, and then reduces the window function value by the decrement value calculated and stored beforehand, as mentioned above. It then multiplies the second waveform sample by the resulting decremented window function value. The window function value is again reduced by the decrement value, and the result is used to scale the third waveform sample of the frame. This process is repeated for all samples of the extrapolated waveform in the current frame.

The waveform attenuator 220 produces the output sq'(n) for the current erased frame, as shown in FIG. 2. The output sq'(n) is passed through switch 202 and becomes the final output speech for the current erased frame. The current frame of sq'(n) is passed to the speech storage module 204 to update the current frame portion of the sq(n) speech buffer stored there. Let sq'(n), n=1, 2, . . . , $N_f$ be the output of the waveform attenuator 220 for the current erased frame, then the sq(n) buffer of the speech storage module 204 is updated as:

$$sq(N+n)=sq'(n), n=1, 2, \ldots, N_f$$

This signal sq'(n) is also passed to a filter memory update module 222 to update the memory 201, or internal states, of the filters within the conventional decoder 100. The filter memory update is performed in order to ensure the filter memory is consistent with the extrapolated speech waveform in the current erased frame. This is necessary for a smooth transition of speech waveform at the beginning of the next frame, if the next frame turns out to be a good frame. If the filter memory 201 were frozen without such proper update, then generally there would be audible glitch or disturbance at the beginning of the next good frame.

In updating the filter memory 201 after a frame erasure, the filter memory update module 222 works backward from the updated speech buffer sq(n) in the conventional decoder 100. If the short-term predictor is of order M, then the updated memory is simply the last M samples of the extrapolated speech signal for the current erased frame, but with the order reversed. Let stsm(k) be the k-th memory value of the short-term synthesis filter 190 of FIG. 1, or the value stored in the delay line corresponding to the k-th short-term predictor 120 coefficient $a_k$. Then, the memory 201 of the short-term synthesis filter is updated as $$stsm(k)=sq(N+N_f+1-k),\ k=1, 2, \ldots, M$$

To update the memory 201 of the FIR long-term predictor 140, the filter memory update module 222 performs short-term prediction error filtering of the extrapolated speech signal of the current frame, with initial memory of the short-term predictor 120 set to the last M samples of the output speech signal in the last frame, with the order reversed. More specifically, let stpm(k) be the k-th memory value for the short-term prediction error filter, then such memory is initialized as $$stpm(k)=sq(N+1-k),\ k=1, 2, \ldots, M$$

The short-term predictor 120 has a transfer function of $$A(z) = 1 - \sum_{k=1}^{M} a_k z^{-k}$$

With stpm(k), k=1, 2, . . . , M as the initial filter memory of A(z), the filter memory update module 222 passes the extrapolated speech for the current erased frame, sq'(n), n=1, 2, . . . , $N_f$ through this filter A(z). The corresponding $N_f$ samples at the output of this filter A(z) are used to update the current frame portion of the momory of the FIR long-term predictor 140.

If none of the side information speech parameters (LPC, pitch period, pitch taps, and excitation gain) is quantized using predictive coding, the operations of the filter memory update module 222 are completed. If, on the other hand, predictive coding is used for side information, then the filter memory update module 222 also needs to update the memory of the involved predictors to minimize the discontinuity of decoded speech parameters at the next good frame.

In an exemplary noise feedback codec that the preferred embodiment of the present invention can be used in, moving-average (MA) predictive coding is used to quantize both the Line-Spectrum Pair (LSP) parameters and the excitation gain. The predictive coding schemes for these parameters work as follows. For each parameter, the long-term mean value of that parameter is calculated off-line and subtracted from the unquantized parameter value. The predicted value of the mean-removed parameter is then subtracted from this mean-removed parameter value. A quantizer (not shown) quantizes the resulting prediction error. The output of the quantizer is used as the input to an associated MA predictor (not shown). The predicted parameter value and the long-term mean value are both added back to the quantizer output value to reconstruct a final quantized parameter value.

In an embodiment of the present invention, the modules 208 through 220 produce the extrapolated speech for the current erased frame. Theoretically, for the current frame, there is no need to extrapolate the side information speech parameters since the output speech waveform has already been generated. However, to ensure that the LSP and gain decoding operations will go smoothly at the next good frame, it is helpful to assume that these parameters are extrapolated from the last frame. This can be done by simply copying the parameter values from the last frame, and then working "backward" from these extrapolated parameter values to update the predictor memory of the predictive quantizers for these parameters.

Using the principle outlined above, a predictor memory in a predictive LSP quantizer can be updated as follows. For the k-th LSP parameter, its predicted value can be calculated as the inner product of the predictor coefficient array and the predictor memory array for the k-th LSP parameter. This predicted value and the long-term mean value of the k-th LSP are then subtracted from the k-th LSP parameter value at the last frame. The resulting value is used to update the newest memory location for the predictor of the k-th LSP parameter (after the original set of predictor memory is shifted by one memory location, as is well-known in the art). This procedure is repeated for all the LSP parameters (there are M of them).

If the frame erasure lasts only 20 ms or less, no waveform attenuation window is applied, and it is assumed that the excitation gain of the current erased frame is the same as the excitation gain of the last frame. In this case, the memory update for the gain predictor is essentially the same as the memory update for the LSP predictors described above. Basically, the predicted value of log-gain is calculated by calculating the inner product of the predictor coefficient array and the predictor memory array for the log-gain. This predicted log-gain and the long-term mean value of the log-gain are then subtracted from the log-gain value of the last frame. The resulting value is used to update the newest memory location for the log-gain predictor (after the original set of predictor memory is shifted by one memory location, as is well-known in the art).

If the frame erasure lasts more than 60 ms, the output speech is zeroed out, and the base-2 log-gain is assumed to be at an artificially set default silence level of −2.5. Again, the predicted log-gain and the long-term mean value of log-gain are subtracted from this default level of −2.5, and the resulting value is used to update the newest memory location for the log-gain predictor.

If the frame erasure lasts more than 20 ms but does not exceed 60 ms, then updating the predictor memory for the predictive gain quantizer is challenging because the extrapolated speech waveform is attenuated using the waveform attenuation window of FIGS. 3(*a*) and (*b*). The log-gain predictor memory is updated based on the log-gain value of the waveform attenuation window in each frame.

To minimize the code size, for each of the frames from the fifth to the twelfth frames into frame erasure, a correction factor from the log-gain of the last frame can be precalculated based on the attenuation window of FIG. 3(*a*) and (*b*). The correction factor is then stored. The following algorithm calculates these 8 correction factors, or log-gain attenuation factors.

1. Initialize lastlg=0. (lastlg=last log-gain=log-gain of the last frame)
2. Initializej=1.
3. Calculate the normalized attenuation window array $$w(n) = 1 - \frac{n-1}{(9-j)N_f},\ n = 1, 2, \ldots, N_f.$$

4. Calculate $lg = 2\log_2\left[\frac{1}{N_f}\sum_{n=1}^{N_f} w^2(n)\right]$

5. Calculate lga(i)=lastlg−lg

6. If $j < 8$, then set $lastlg = lg - 2\log_2\left(\frac{8-j}{9-j}\right)$

7. Ifj=8, stop; otherwise, increment j by 1 (i.e., j←j+1), then go back to step 3.

The algorithm above calculates the base-2 log-gain value of the waveform attenuation window for a given frame. It then determines the difference between this value and a similarly calculated log-gain for the window of the previous frame, compensated for the normalization of the start of the window to unity for each frame. The output of this algorithm is the array of log-gain attenuation factors lga(j) for j=1, 2, . . . , 8. Note that lga(j) corresponds to the (4+j)-th frame into frame erasure.

Once the lga(j) array has been pre-calculated and stored, then the log-gain predictor memory update for frame erasure lasting 20 ms to 60 ms becomes straightforward. If the current erased frame is the j-th frame into frame erasure (4<j≦12), lga(j-4) is subtracted from the log-gain value of the last frame. From the result of this subtraction, the predicted log-gain and the long-term mean value of log-gain are subtracted, and the resulting value is used to update the newest memory location for the log-gain predictor.

After the filter memory update module 222 calculates all the updated filter memory values, the conventional decoder 100 uses these values to update the memory 201. In particular, it updates the memory of its short-term synthesis filter 190, its long-term synthesis filter 180, and all of the predictors, if any, used in side information quantizers, in preparation for the decoding of the next frame, assuming the next frame will be received intact.

Figure 4A:
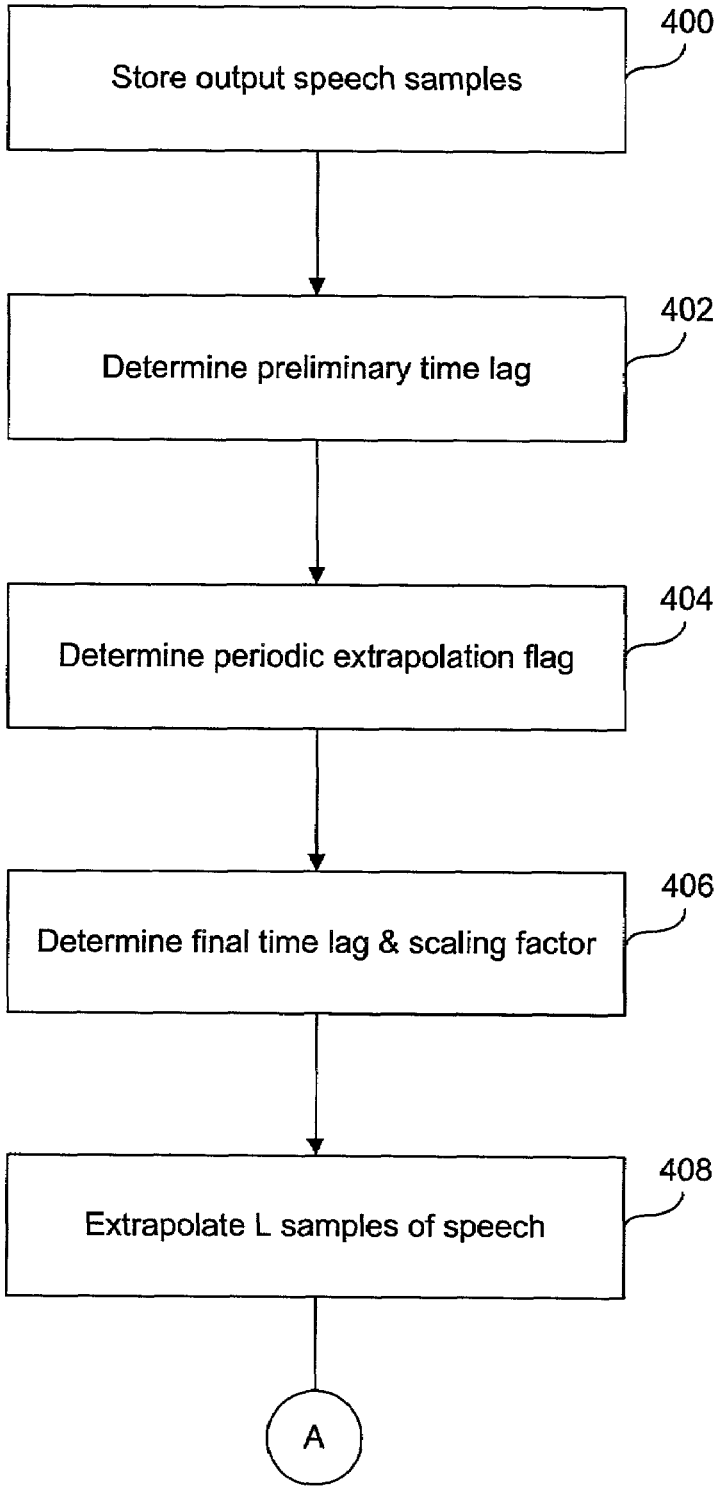
FIG. 4(*a*) is a flowchart illustrating an exemplary method of performing frame erasure concealment in accordance with the present invention.
Figure 4B:
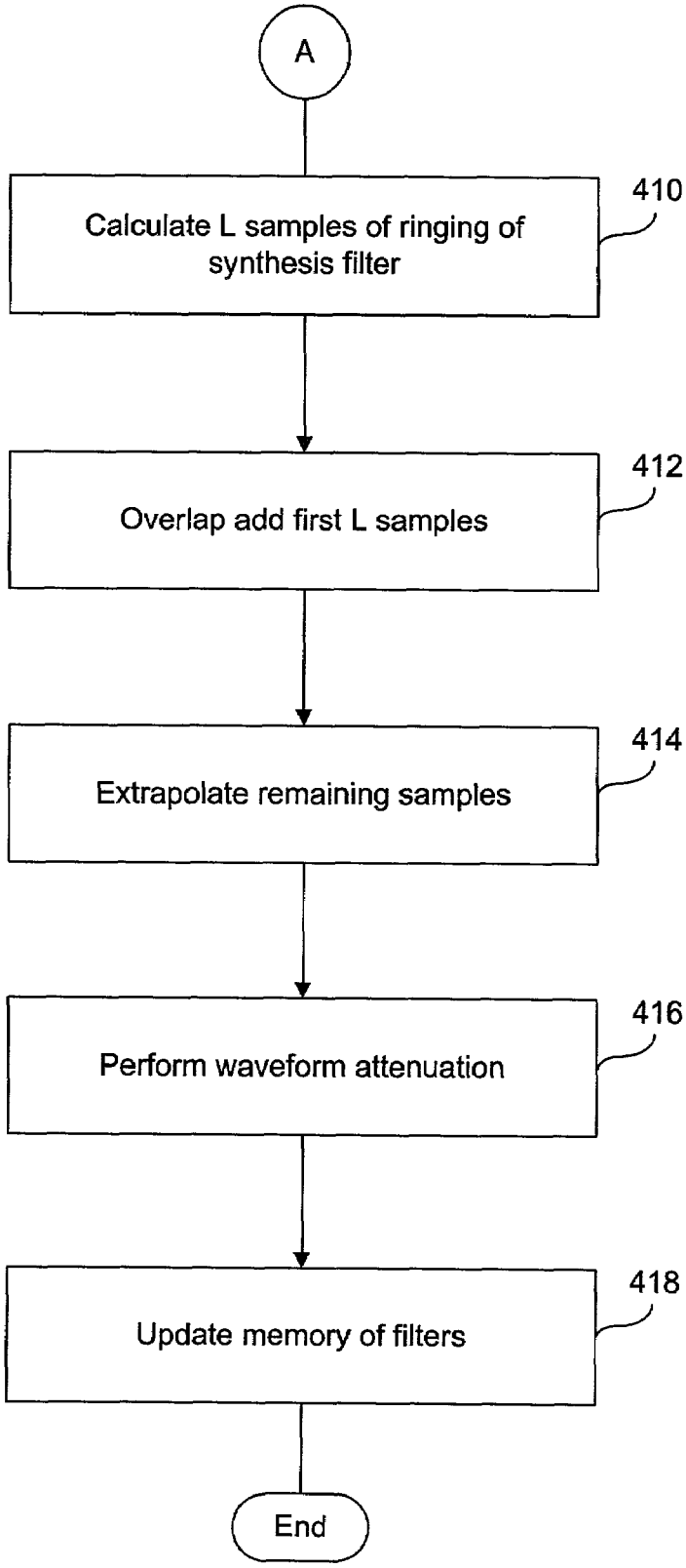

FIGS. 4(*a*) and 4(*b*) provide an exemplary method of practicing the preferred embodiment of the present invention. The present invention begins by storing samples of the output decoded signal in a memory, as indicated in block 400. The decoded speech waveform, output from the decoder 100, is analyzed and the preliminary time lag value is determined in block 402. Next, the signal output from the operation of the block 402 is analyzed and classified to determine whether or not periodic repetition can be performed. If the signal is determined to be sufficiently periodic, the periodic repetition flag is set, and the final time lag and the scaling factor are determined as indicated in blocks 404 and 406 respectively.

After determination of the final time lag and the scaling factor, the present invention extrapolates L samples of speech and calculates L samples of ringing of the synthesis filter module 195, based upon the determined final time lag and the determined scaling factor, as shown in blocks 408 and 410 respectively. The L extrapolated samples and the L samples of ringing of the synthesis filter are then overlap-added as indicated in block 412. The remaining samples are then extrapolated as indicated in block 414. The blocks 408, 410, 412, and 414 cooperatively function to remove potential discontinuities between frames. If frame erasure continues, a waveform attenuation process is initiated in block 416. Finally, the memory of the filters is updated to ensure that its contents are consistent with the extrapolated speech waveform in the current erased frame, as shown in block 418, and the process ends.

Figure 5:
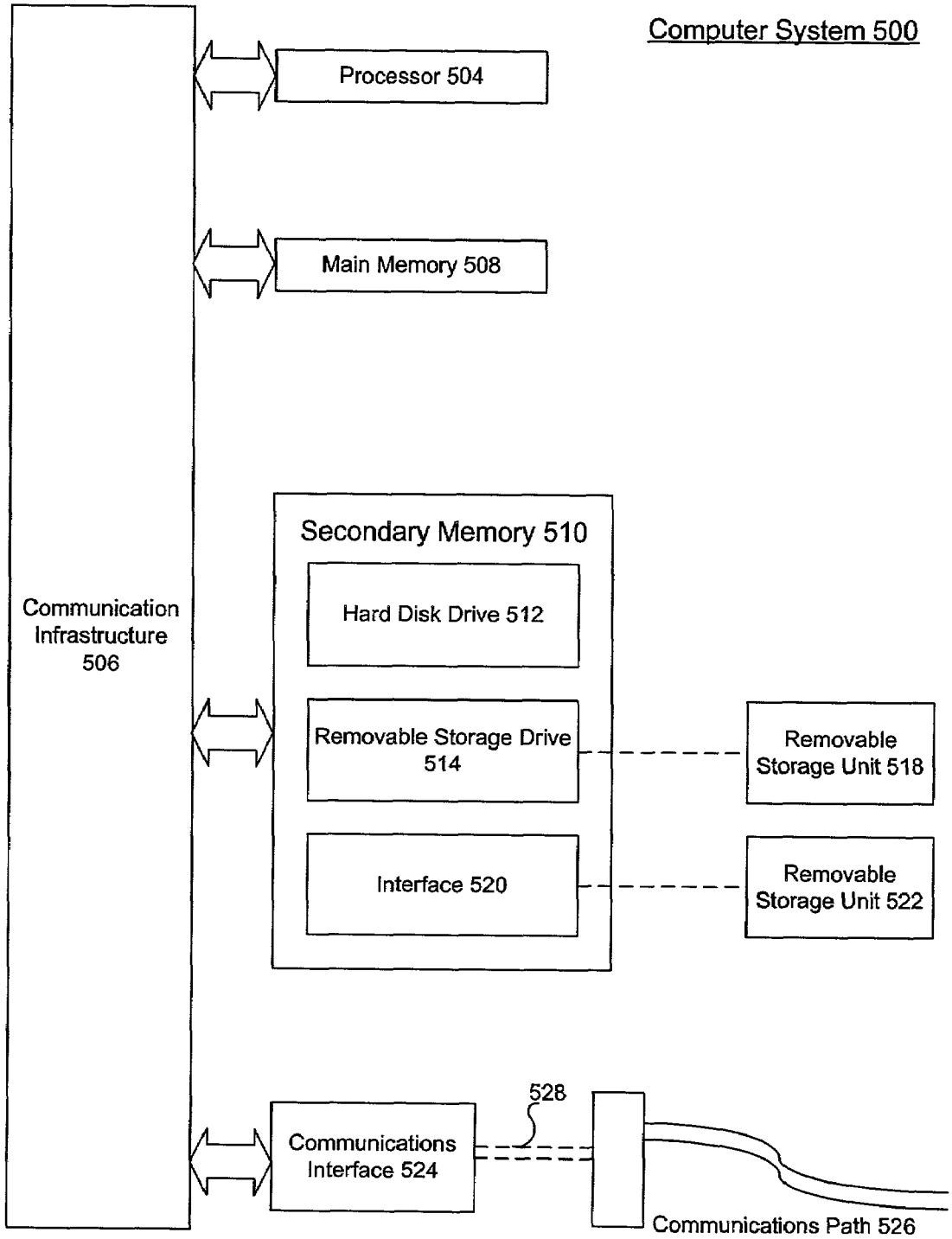
FIG. 5 is a block diagram of an exemplary computer system on which the present invention can be practiced.

The following description of a general purpose computer system is provided for completeness. As stated above, the present invention can be implemented in hardware, or as a combination of software and hardware. Consequently, the invention may be implemented in the environment of a computer system or other processing system. An example of such a computer system 500 is shown in FIG. 5. In the present invention, all of the elements depicted in FIGS. 1 and 2, for example, can execute on one or more distinct computer systems 500, to implement the various methods of the present invention.

The computer system 500 includes one or more processors, such as a processor 504. The processor 504 can be a special purpose or a general purpose digital signal processor and it's connected to a communication infrastructure 506 (for example, a bus or network). Various software implementations are described in terms of this exemplary computer system. After reading this description, it will become apparent to a person skilled in the relevant art how to implement the invention using other computer systems and/or computer architectures.

The computer system 500 also includes a main memory 508, preferably random access memory (RAM), and may also include a secondary memory 510. The secondary memory 510 may include, for example, a hard disk drive 512 and/or a removable storage drive 514, representing a floppy disk drive, a magnetic tape drive, an optical disk drive, etc. The removable storage drive 514 reads from and/or writes to a removable storage unit 518 in a well known manner. The removable storage unit 518, represents a floppy disk, magnetic tape, optical disk, etc. which is read by and written to by removable storage drive 514. As will be appreciated, the removable storage unit 518 includes a computer usable storage medium having stored therein computer software and/or data.

In alternative implementations, the secondary memory 510 may include other similar means for allowing computer programs or other instructions to be loaded into the computer system 500. Such means may include, for example, a removable storage unit 522 and an interface 520. Examples of such means may include a program cartridge and cartridge interface (such as that found in video game devices), a removable memory chip (such as an EPROM, or PROM) and associated socket, and the other removable storage units 522 and the interfaces 520 which allow software and data to be transferred from the removable storage unit 522 to the computer system 500.

The computer system 500 may also include a communications interface 524. The communications interface 524 allows software and data to be transferred between the computer system 500 and external devices. Examples of the communications interface 524 may include a modem, a network interface (such as an Ethernet card), a communications port, a PCMCIA slot and card, etc. Software and data transferred via the communications interface 524 are in the form of signals 528 which may be electronic, electromagnetic, optical or other signals capable of being received by the communications interface 524. These signals 528 are provided to the communications interface 524 via a communications path 526. The communications path 526 carries the signals 528 and may be implemented using wire or cable, fiber optics, a phone line, a cellular phone link, an RF link and other communications channels.

In the present application, the terms "computer readable medium" and "computer usable medium" are used to generally refer to media such as the removable storage drive 514, a hard disk installed in the hard disk drive 512, and the signals 528. These computer program products are means for providing software to the computer system 500.

Computer programs (also called computer control logic) are stored in the main memory 508 and/or the secondary memory 510. Computer programs may also be received via the communications interface 524. Such computer programs, when executed, enable the computer system 500 to implement the present invention as discussed herein.

In particular, the computer programs, when executed, enable the processor 504 to implement the processes of the present invention. Accordingly, such computer programs represent controllers of the computer system 500. By way of example, in the embodiments of the invention, the processes/methods performed by signal processing blocks of encoders and/or decoders can be performed by computer control logic. Where the invention is implemented using software, the software may be stored in a computer program product and loaded into the computer system 500 using the removable storage drive 514, the hard drive 512 or the communications interface 524.

In another embodiment, features of the invention are implemented primarily in hardware using, for example, hardware components such as Application Specific Integrated Circuits (ASICs) and gate arrays. Implementation of a hardware state machine so as to perform the functions described herein will also be apparent to persons skilled in the relevant art(s).

The foregoing description of the preferred embodiments provide an illustration and description, but is not intended to be exhaustive or to limit the invention to the precise form disclosed. Modifications and variations are possible consistent with the above teachings, or may be acquired from practice of the invention.

I claim:

1. A method of processing an extrapolated signal including a number of consecutive replacement frames, the method comprising:

attenuating a portion of the extrapolated signal when the extrapolated signal reaches a predetermined duration;

wherein the attenuating produces an output signal (sq'(n)) having an attenuated portion, the output signal (sq'(n)) including the number of consecutive replacement frames;

wherein each of the consecutive frames within the attenuated portion is attenuated by applying an attenuation window having a plurality of windowing sections, selected ones of the sections having (i) a starting magnitude value of approximately 1 and (ii) an ending magnitude value different from ending magnitude values of others of the selected ones of windowing sections, each of the ending magnitude values decreasing over time.

2. The method of claim 1, wherein the attenuating immediately commences when the extrapolated signal reaches the predetermined duration.

3. The method of claim 2, wherein the attenuating is linear.

4. The method of claim 3, further comprising respectively storing the difference between magnitudes of adjacent samples in each attenuation window.

5. The method of claim 4, wherein the predetermined duration is about 20 milliseconds.

6. The method of claim 1, wherein the decoded signal is a speech signal.

7. An apparatus for processing an extrapolated signal including a number of consecutive replacement frames, the apparatus comprising:

means for attenuating a portion of the extrapolated signal when the extrapolated signal reaches a predetermined duration;

wherein the attenuating produces an output signal (sq'(n)) having an attenuated portion, the output signal (sq'(n)) including the number of consecutive replacement frames;

wherein each of the consecutive frames within the attenuated portion is attenuated by applying an attenuation window having a plurality of windowing sections, selected ones of the sections having (i) a starting magnitude value of approximately 1 and (ii) an ending magnitude value different from ending magnitude values of others of the selected ones of windowing sections, each of the ending magnitude values decreasing over time.

8. The apparatus of claim 7, wherein the attenuating immediately commences when the extrapolated signal reaches the predetermined duration.

9. The apparatus of claim 8, wherein the attenuating is linear.

10. The apparatus of claim 9, further comprising respectively storing the difference between magnitudes of adjacent samples in each attenuation window.

11. The apparatus of claim 10, wherein the predetermined duration is about 20 milliseconds.

12. The apparatus of claim 7, wherein the decoded signal is a speech signal.

13. A tangible computer readable medium carrying one or more sequences of one or more instructions for execution by one or more processors to perform a method of processing an extrapolated signal including a number of consecutive replacement frames, the instructions when executed by the one or more processors, cause the one or more processors to perform the steps of:

attenuating a portion of the extrapolated signal when the extrapolated signal reaches a predetermined duration;

wherein the attenuating produces an output signal (sq'(n)) having an attenuated portion, the output signal (sq'(n)) including the number of consecutive replacement frames;

wherein each of the consecutive frames within the attenuated portion is attenuated by applying an attenuation window having a plurality of windowing sections, selected ones of the sections having (i) a starting magnitude value of approximately 1 and (ii) an ending magnitude value different from ending magnitude values of others of the selected ones of windowing sections, each of the ending magnitude values decreasing over time.

14. The tangible computer readable medium of claim 13, wherein the attenuating immediately commences when the extrapolated signal reaches the predetermined duration.

15. The tangible computer readable medium of claim 14, wherein the attenuating is linear.

16. The tangible computer readable medium of claim 15, carrying the one or more instructions, further causing the one or more processors to store the difference between magnitudes of adjacent samples in each attenuation window.

17. The tangible computer readable medium of claim 16, wherein the predetermined duration is about 20 milliseconds.

18. The tangible computer readable medium of claim 13, wherein the decoded signal is a speech signal.

* * * * *